US009393790B2

(12) United States Patent
Kano et al.

(10) Patent No.: US 9,393,790 B2
(45) Date of Patent: Jul. 19, 2016

(54) INKJET PRINT APPARATUS AND INKJET PRINTING METHOD

(75) Inventors: Yutaka Kano, Yokohama (JP); Susumu Hirosawa, Tokyo (JP); Kentarou Muro, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 516 days.

(21) Appl. No.: 12/963,688

(22) Filed: Dec. 9, 2010

(65) Prior Publication Data

US 2012/0050375 A1 Mar. 1, 2012

(30) Foreign Application Priority Data

Aug. 24, 2010 (JP) ..... 2010-187224

(51) Int. Cl.
*B41J 29/393* (2006.01)
*B41J 2/165* (2006.01)
*B41J 2/21* (2006.01)

(52) U.S. Cl.
CPC ..... *B41J 2/16579* (2013.01); *B41J 2/2146* (2013.01)

(58) Field of Classification Search
None
See application file for complete search history.

(56) References Cited

U.S. PATENT DOCUMENTS 5,903,288 A * 5/1999 Yamaguchi ..... 347/24
6,357,846 B1 * 3/2002 Kitahara ..... B41J 2/04553 347/10
6,538,770 B1 * 3/2003 Mestha ..... 358/1.9
7,722,152 B2 5/2010 Miyamoto et al.
7,726,763 B2 6/2010 Ochiai et al.
8,277,020 B2 * 10/2012 Miyamoto et al. ..... 347/23
2003/0174186 A1 * 9/2003 Valero et al. ..... 347/35
2005/0094196 A1 * 5/2005 Saito et al. ..... 358/1.15
2008/0036803 A1 * 2/2008 Yun ..... B41J 2/2139 347/9
2008/0136855 A1 6/2008 Ochiai et al.
2010/0053250 A1 * 3/2010 Ito ..... B41J 29/393 347/16
2010/0091053 A1 * 4/2010 Jackson ..... B41J 29/393 347/9
2010/0194809 A1 * 8/2010 Miyamoto ..... B41J 2/16526 347/14

FOREIGN PATENT DOCUMENTS

CN 101229716 A 7/2008
JP 2008-168628 A 7/2008
JP 2009-255480 A 11/2009

OTHER PUBLICATIONS

Office Action issued in Chinese Application No. 201110253496.X dated Dec. 18, 2013.
Office Action issued in Chinese Patent Application No. 201110253496.X, dated Oct. 29, 2015.
U.S. Appl. No. 12/963,690, Kentaru Muro et al., filed Dec. 9, 2010.

* cited by examiner

*Primary Examiner* — Bradley Thies
(74) *Attorney, Agent, or Firm* — Fitzpatrick, Cella, Harper & Scinto

(57) ABSTRACT

In the case of printing a test pattern with an inkjet print apparatus, two printing modes are prepared. In one printing mode, a preliminary ejection on the printing medium is performed during printing of a test pattern, and in the other printing mode, the preliminary ejection on the printing medium is not performed during printing of a test pattern. For a test pattern that is, if the test pattern is printed under the same condition as that for an actual image, convenient for a subsequent correction, the preliminary ejection on the printing medium is performed during printing of the test pattern. On the other hand, for a test pattern in which, if an irrelevant dot is printed within the pattern, inconvenience is taken into consideration in a subsequent correction, the preliminary ejection on the printing medium is not performed during printing of the test pattern.

12 Claims, 12 Drawing Sheets

| PRINTING DATA | PRELIMINARY EJECTION ON PAPER | |
|---|---|---|
| IMAGE | ON | THIRD PRINTING MODE |
| COLOR SHADING PATTERN | ON | FIRST PRINTING MODE |
| HEAD SHADING PATTERN | OFF | SECOND PRINTING MODE |
| PWM CORRECTION PATTERN | OFF | |
| Pth CORRECTION PATTERN | OFF | |
| NON-EJECTION COMPLEMENT PATTERN | OFF | |
| REGISTRATION ADJUSTING PATTERN | OFF | |

| PRINTING DATA | PRELIMINARY EJECTION ON PAPER | |
|---|---|---|
| IMAGE | ON | THIRD PRINTING MODE |
| COLOR SHADING PATTERN | ON | FIRST PRINTING MODE |
| HEAD SHADING PATTERN | OFF | SECOND PRINTING MODE |
| PWM CORRECTION PATTERN | OFF | |
| Pth CORRECTION PATTERN | OFF | |
| NON-EJECTION COMPLEMENT PATTERN | OFF | |
| REGISTRATION ADJUSTING PATTERN | OFF | |

FIG.11

INKJET PRINT APPARATUS AND INKJET PRINTING METHOD

BACKGROUND OF THE INVENTION

1. Field of the Invention

The present invention relates to an inkjet print apparatus and inkjet printing method that eject ink from a plurality of ejection ports onto a printing medium to thereby perform printing. More particularly, the present invention relates to preliminary ejection on a printing medium that, in order to maintain a stable ejection state from the plurality of ejection ports, performs ejection irrelevant to any image toward the printing medium in printing.

2. Description of the Related Art

An inkjet print apparatus ejects ink from an individual printing element depending on the image data to print a desired image on a printing medium. In such an inkjet print apparatus, along with evaporation of ink from an ejection port, the ink inside the printing element is increased in viscosity or fixed. Therefore a printing element having a low ejection frequency ejects ink that is denser than necessary, or it cannot perform normal ejection. Even in the printing element in which the increasing in viscosity or fixing occurs, if ejection is performed several times, a dot density or ejection state can be restored. However, the increasing in viscosity or fixing proceeds along within a period of time during which ink is not ejected (non-ejection period), and therefore the number of ejections necessary for restoring to normal ejection is also increased as the non-ejection period increases (see FIG. 12). For this reason, in an individual printing element, it is desirable to perform ejection at a certain level of frequency.

However, the ejecting operation of each printing element depends on the image data, and therefore only with printing an actual image, it is difficult to maintain a desired ejection frequency in all printing elements. Accordingly, in many inkjet print apparatuses, by appropriately performing ejection irrelevant to image data (so-called preliminary ejection), the ejection state is stabilized in all printing elements.

In recent years, as large-sized printing has widely spread and printing elements are ejecting smaller droplets, even during printing on a sheet of printing medium, the preliminary ejection may be required. At this time, in the case of, for example, a serial type inkjet print apparatus, a carriage can be moved for every main scanning to a position away from the printing medium to perform the preliminary ejection into a cap that is prepared in advance. However, in the case of a full-line type print apparatus to which a printing head is fixed, the printing head cannot be moved away from the printing medium until the completion of printing on a sheet of printing medium.

In order to deal with such a problem, for example, Japanese Patent Laid-Open No. 2009-255180 discloses a method for, in a full-line type inkjet print apparatus, performing preliminary ink ejection to the extent that the preliminary ejection does not stand out on the sheet of printing medium printed with the image (so-called preliminary ejection on printing medium). If the method disclosed in Japanese Patent Laid-Open. No. 2009-255480 is employed, the preliminary ejection can be performed during printing of an image, so that the extension of the printing time for performing the preliminary ejection irrelevant to the image can be eliminated, and quick printing on a large-sized printing medium can be performed in a stable ejection state.

The inkjet print apparatus is provided with a mode in which, in order to maintain high quality image output, various test patterns are printed at arbitrary timings to check printing states of printing heads. Also, by making corrections of printing data on the basis of the result of reading the test patterns by using the naked eye or sensor, image defects occurring along with an ejection variation among the printing heads or an error of the print apparatus can be reduced.

Meanwhile, even during the printing of such test patterns, evaporation of ink from the printing element that has not performed ejection for a while proceeds, and therefore even during the printing of the test patterns, the ejection state of the printing element may become unstable. Accordingly, if an ejection state of an individual printing element is taken into consideration, even during the printing of the test patterns, it is desirable to perform the preliminary ejection on printing medium. However, depending on the type or purpose of the test pattern, it may not be preferable to print a dot irrelevant to the pattern during printing of the test pattern. This is because if an irrelevant dot is printed by the preliminary ejection within the test pattern, information to be read from the pattern cannot be accurately detected, and even if various corrections are made according to the obtained information, image quality may not be improved. Thus, when the test pattern is printed, it is difficult to print the test pattern with high reliability while stabilizing the ejection state of printing elements. Japanese Patent Laid-Open No. 2009-255480 also describes the method for performing the preliminary ejection on printing medium while printing an actual image, but does not deal with the preliminary ejection on printing medium in the case of printing a test pattern as described above, at all.

SUMMARY OF THE INVENTION

The present invention is made in order to solve the above-described problem. Therefore, an object of the present invention is to provide a method for, in the case of printing a test pattern, performing preliminary ejection on printing medium to stabilize the ejection state of printing elements without losing reliability of the test pattern.

The first aspect of the present invention is an inkjet print apparatus comprising: a printing unit configured to print to a print medium by ejecting ink from a plurality of printing elements during a relative movement with respect to the printing medium; and a executing unit configured to execute a first print mode in which a preliminary ejection on the printing medium for recovering the plurality of printing elements is performed during printing of a first test pattern, and execute a second print mode in which the preliminary ejection on the printing medium is not performed during printing of a second test pattern being different from the first test pattern.

The second aspect of the present invention is an inkjet printing method comprising the steps of: printing onto a print medium during a relative movement between a plurality of printing elements ejecting inks and the printing medium; and executing a first print mode in which a preliminary ejection on the printing medium for recovering an ejection state of the plurality of printing elements is performed during printing of a first test pattern, and a second print mode in which the preliminary ejection on the printing medium is not performed during printing of a second test pattern being different from the first test pattern.

Further features of the present invention will become apparent from the following description of exemplary embodiments (with reference to the attached drawings).

BRIEF DESCRIPTION OF THE DRAWINGS

FIG. 11 is a diagram illustrating the relationship between images to be printed and ON/OFF positions of the preliminary ejection on printing medium.

DESCRIPTION OF THE EMBODIMENTS

Figure 1:
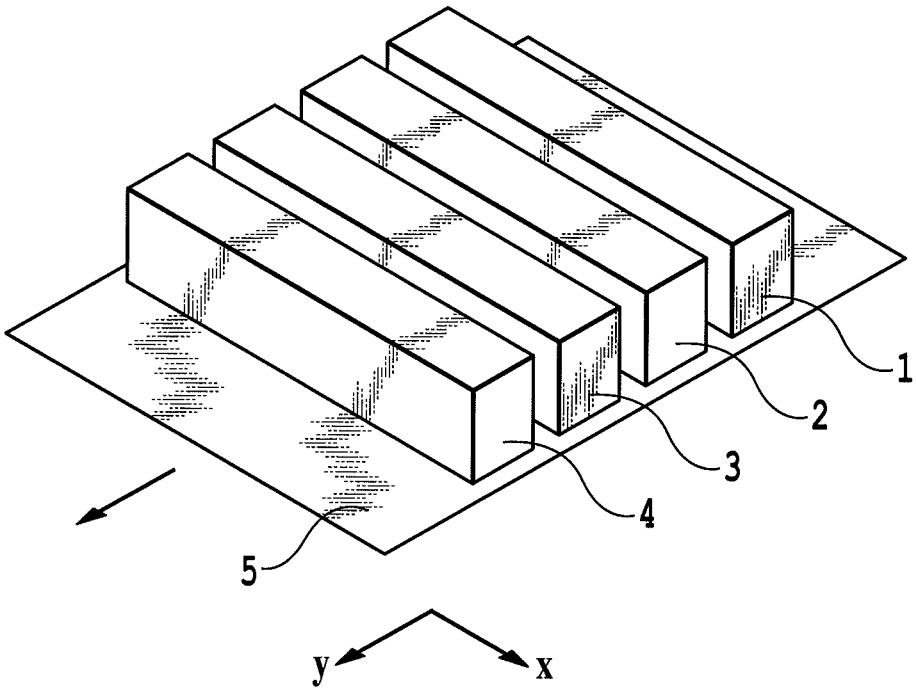
FIG. 1 is a perspective view illustrating a configuration of a printing unit of a full-line type inkjet print apparatus.

FIG. 1 is a perspective view illustrating the configuration of a printing unit of a full-line type inkjet print apparatus according to the present embodiment. Long printing heads 1 to 4 fixed inside the print apparatus are respectively for ejecting black (K), cyan (C), magenta (M), and yellow (Y) ink, and in each of the printing heads, a plurality of printing elements are arrayed in an x-direction at pitches corresponding to a printing resolution. Although not illustrated in the diagram, each of the printing heads 1 to 4 is connected with a tube for supplying ink thereto, and a cable for transmitting an ejection signal. Also, each of the printing elements follows data transmitted through the cable to eject ink toward a printing medium 5 at a predetermined frequency.

The printing medium 5 such as plain paper, high quality dedicated paper, OHP sheet, glossy paper, glossy film, or postcard is held between unillustrated conveying rollers and discharging rollers, and along with the driving of a conveying motor, conveyed in a y-direction intersecting with the x-direction at a constant speed corresponding to the above ejection frequency.

When the print apparatus does not perform printing, ejection ports of the printing heads 1 to 4 are sealed by unillustrated caps. This enables ink increasing in viscosity or fixing, or clogging of the ejection port due to a foreign material such as dust to be prevented. Also, during non-printing, preliminary ejecting operation can also be performed toward the caps. Further, by using an unillustrated pump to introduce negative pressure into the caps with the ejection ports being sealed by the caps, predetermined amounts of ink can be forcibly discharged from the ejection ports to remove the ink increased viscosity, bubbles, or foreign material such as dust. Also, a blade is arranged in a position adjacent to the caps, which can wipe ejection port surfaces of the printing heads.

Figure 2:
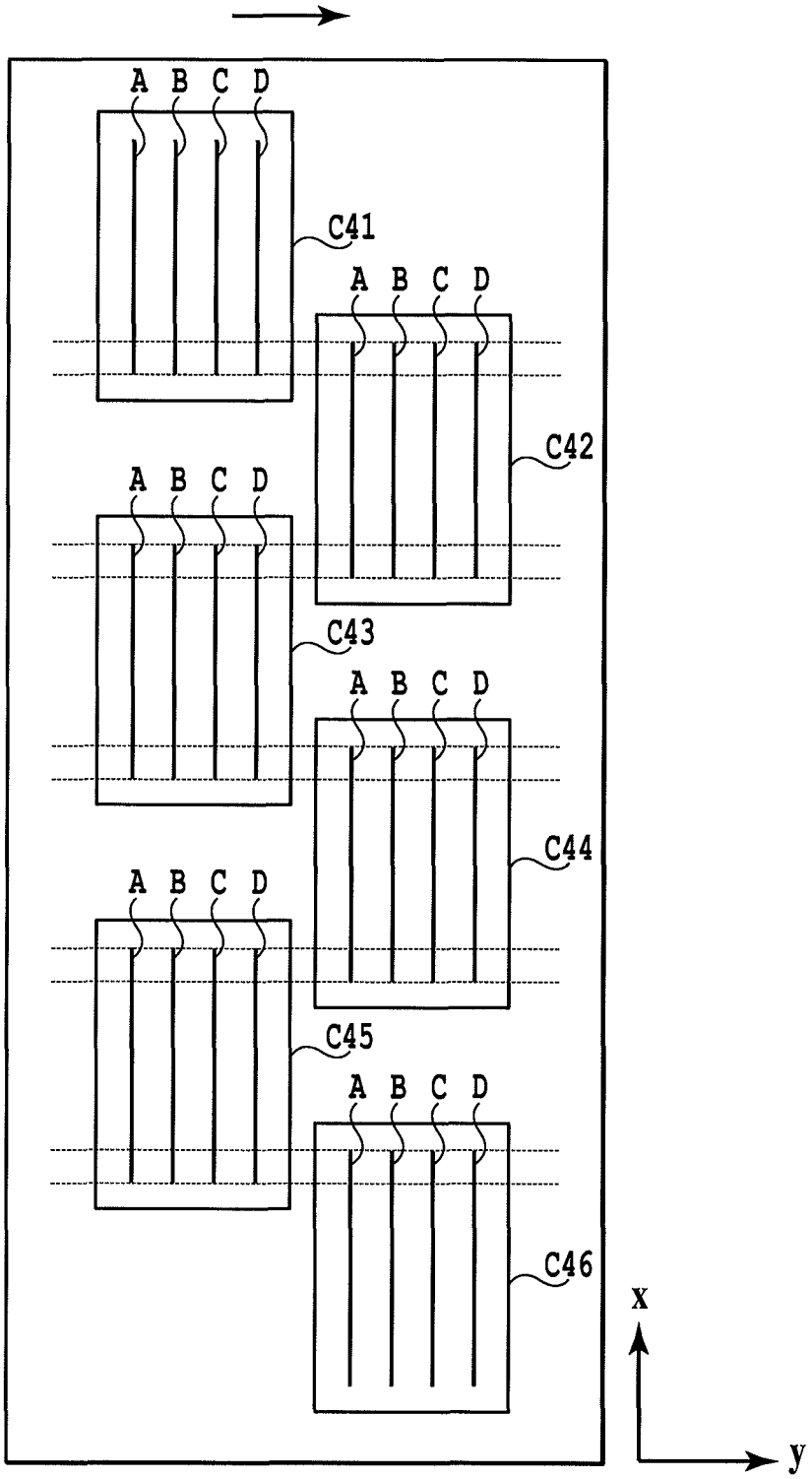
FIG. 2 is a schematic diagram illustrating an array configuration of ejection ports of a printing head.

FIG. 2 is a schematic diagram illustrating an array configuration of ejection ports for one of the colors corresponding to the printing heads 1 to 4. In the printing head of the present embodiment, six chips C41 to C46 of the same type are arranged such that, as illustrated in the diagram, the chips C41 to C96 are alternately displaced in the y-direction and the ejection ports are made continuous in the x-direction. In each of the chips, ejection port arrays in which the plurality of ejection ports are arrayed in the x-direction at pitches of 1200 dpi are arranged in a parallel position in the y-direction on the four array basis.

Figure 3:
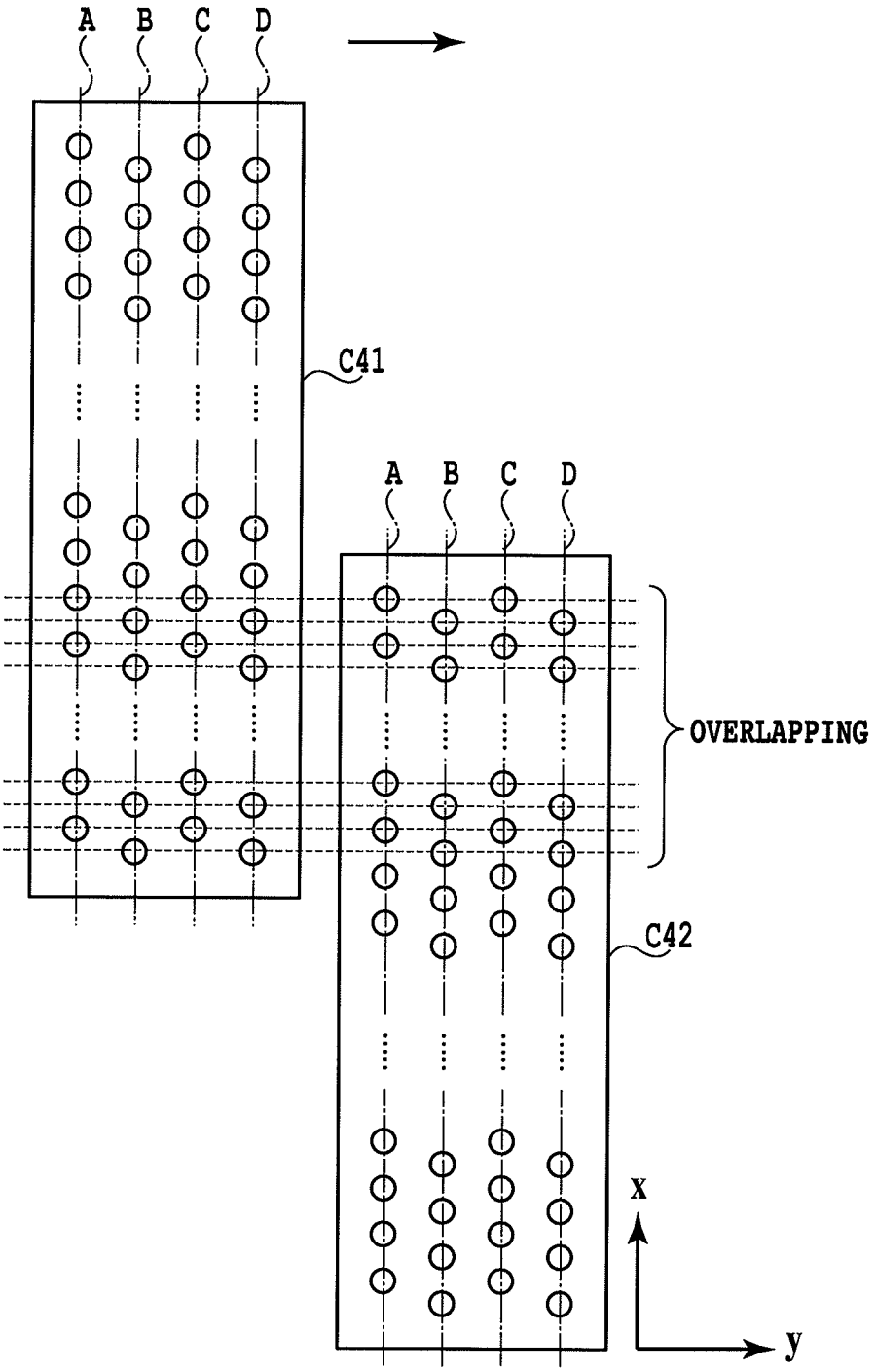
FIG. 3 is an enlarged diagram for describing array states of ejection ports in two adjacent chips.

FIG. 3 is an enlarged diagram for describing array states of the ejection ports in the chips C41 and C42. Each of the chips C41 and C42 has four nozzle arrays A to D, and in each of the ejection port arrays, the plurality of ejection ports are arrayed in the x-direction at a pitch of 1200 dpi. Here, the ejection port arrays A and C are arranged in a parallel position such that the ejection ports are positioned at the same positions in the x-direction. Also, the ejection port arrays B and D are also arranged in a parallel position such that the ejection ports are positioned at the same positions in the x-direction. However, the nozzle arrays B and D are arranged in parallel such that the ejection ports are arranged at positions that are displaced by a half pitch in the x-direction with respect to positions of the ejection ports of the nozzle arrays A and C.

On the other hand, the chips C41 and C42 are arranged with an overlapping portion being provided such that the chips C41 and C42 are displaced in the y-direction as illustrated in the diagram, and the ejection ports are made continuous in the x-direction. The width of the overlapping portion in the x-direction is assumed to correspond to 16 pixels in the case of 2400 dpi. Also, areas in the ejection port arrays, which are not included in the overlapping portion, are referred to as non-overlapping portions. The array configuration as described above is common to all of the chips C41 to C46.

Based on such a configuration, by ejecting ink from each of the ejection ports at the predetermined frequency while conveying the printing medium in the y-direction, dots can be printed on the printing medium with a resolution of 2400 dpi in the x-direction. Also, the overlapping portion is provided between two chips, and therefore even if some chip arrangement error is present on the printing head, no gap is created between the chips and a white stripe can be avoided from occurring on the printed image.

Further, in the same line extending in the y-direction in the non-overlapping portion, the two ejection port arrays A and C, or B and D print dots. Also, in the overlapping portion, the four ejection port arrays in total, i.e., the ejection port arrays A and C of the two chips, or the ejection port arrays B and D of the two chips, print dots. As described, by alternately printing the pluralities of dots in the same lines extending in the y-direction with the pluralities of ejection ports (printing elements), dots printed by a specific printing element can be avoided from being arranged continuously in a line, and a variation in ejection property among respective printing elements can be prevented from standing out on the image.

Figure 4:
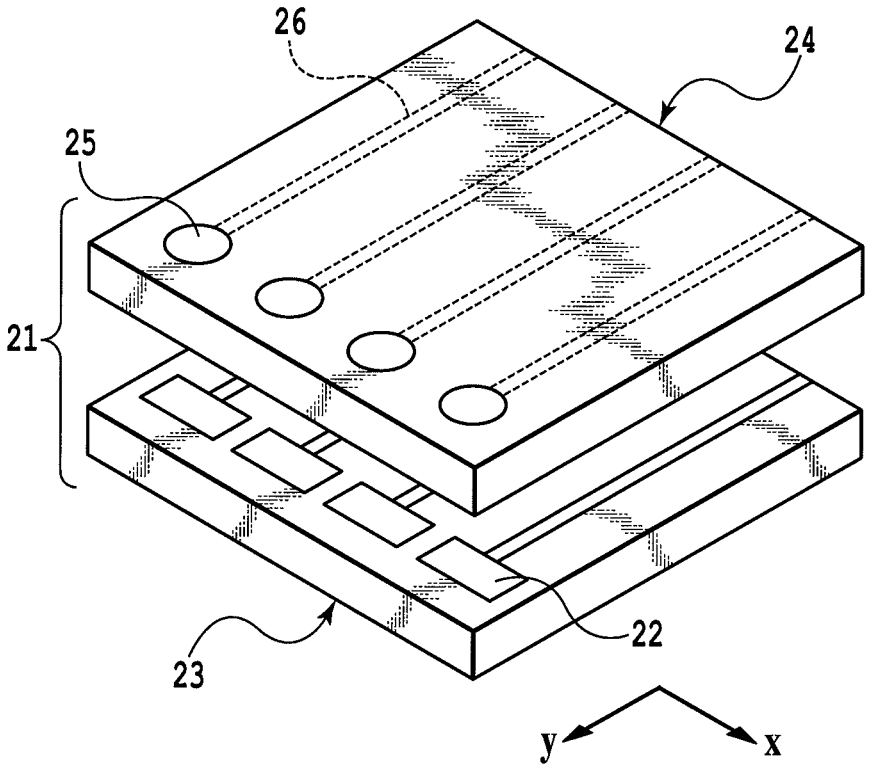
FIG. 4 is a schematic diagram for describing an internal configuration of an ejection portion inside a chip.

FIG. 4 is a schematic diagram for describing an internal configuration of an ejection portion inside the chip. Here, for simplicity, components of four printing elements are illustrated. The chip 21 mainly consists of a heater board 23 formed with a plurality of heaters and a top board 24 formed with ejection ports at positions corresponding to the respective heaters, that are attached to each other. One printing element includes the following: the heater 22 that produces heat according to a printing signal, a liquid path 26 that introduces ink to the heater 22, and the ejection port 25 that ejects the ink by foaming energy generated in the heater 22.

Figure 5:
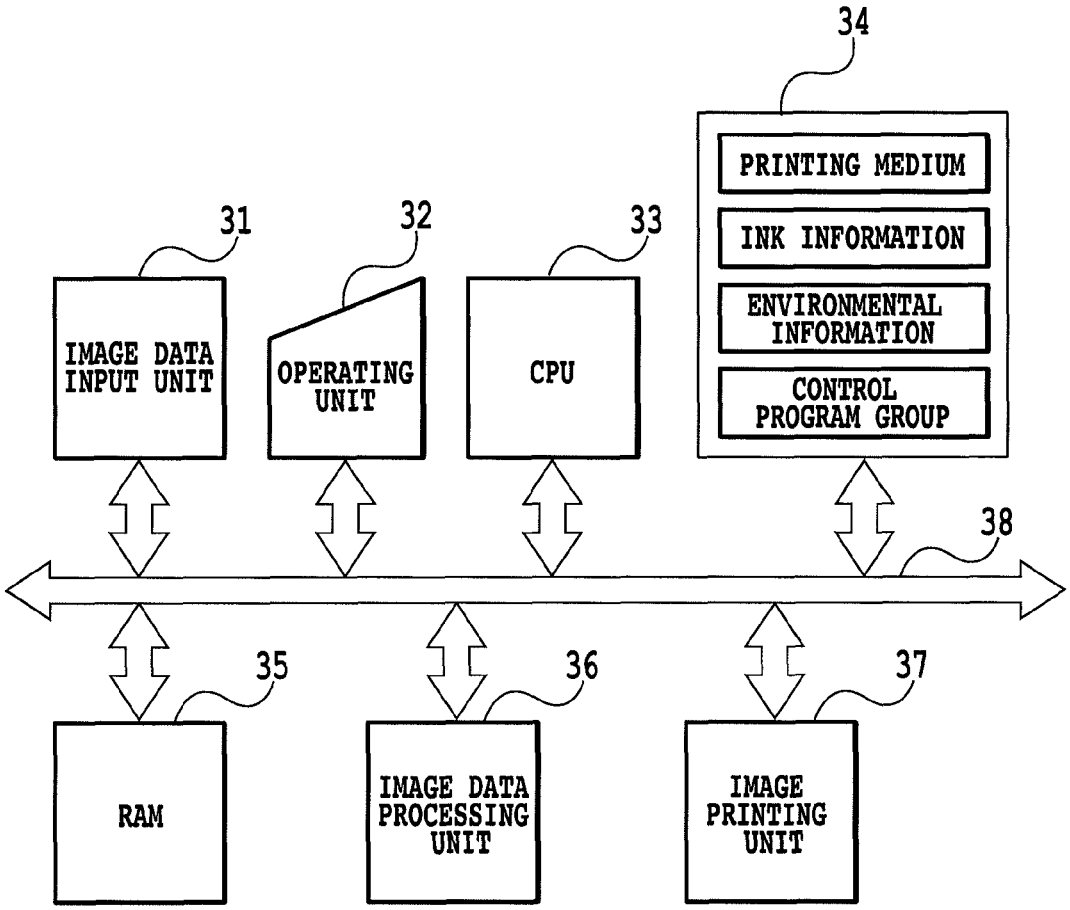
FIG. 5 is a block diagram illustrating a configuration of a control system related to image processing.

FIG. 5 is a block diagram illustrating a configuration of a control system related to image processing in the inkjet print apparatus of the present embodiment. Multi-value image data from an image input device such as a scanner or digital camera, or multi-valued image data stored in a hard disk or the like of a personal computer are inputted through an image data input unit 31. An operating unit 32 is provided with various keys for a user to set various parameters and instruct the start of printing when the user performs the printing. A CPU 33 controls the entire print apparatus according to a control program stored in a storage medium 34. The storage medium 34 stores, in addition to the above control program, information on the types of printing media and ink that can be handled in the print apparatus, information on environmental temperature, and various parameters used to perform the image processing. For such a storage medium 34, a ROM, FD, CD-ROM, HD, memory card, magnetooptical disk, or the like can be used. A RAM 35 is used as a work area for various programs in the storage medium 34, a temporary save area for error processing, and a work area for the image processing. The RAM 35 can also copy various tables in the storage medium 34, then change pieces of content of the tables, and refer to the changed tables to proceed with the image processing.

An image data processing unit 36 performs image processing for converting the multi-value image data inputted from the image data input unit 31 to binary data that are printable by the printing heads of an image printing unit. The image printing unit 37 is configured on the basis of the mechanism that is described using FIG. 1, and on the basis of the binary data generated in the image data processing unit 36, ejects inks from corresponding ejection ports 25 to form a dot image on a printing medium. A bus line 38 transmits an address signal, data, control signal, and the like within the present print apparatus.

Figure 6:
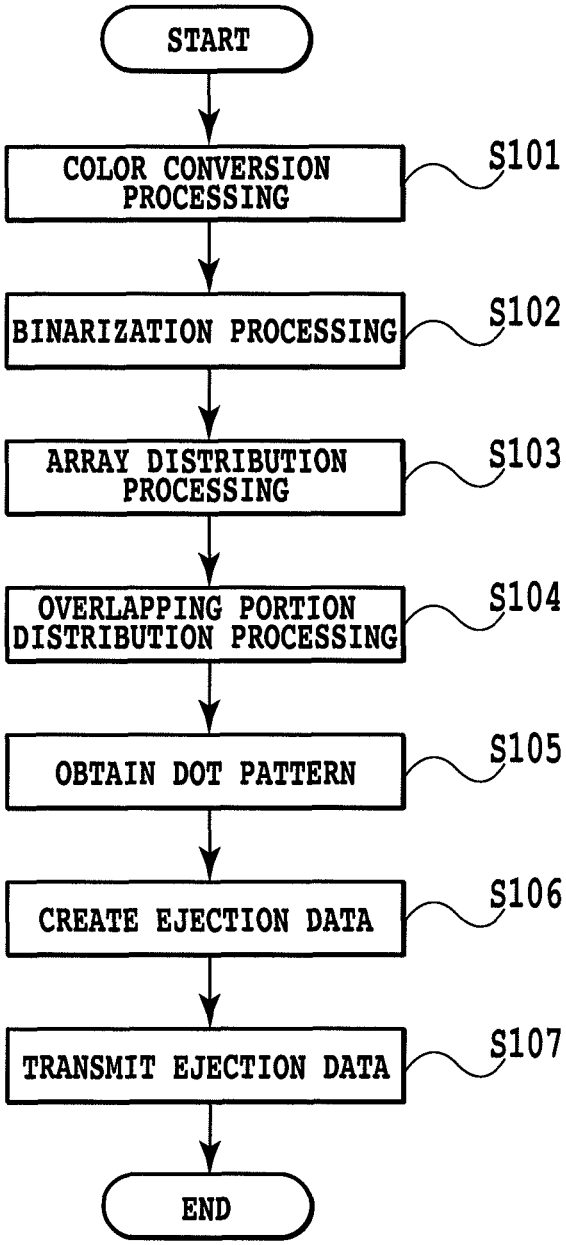
FIG. 6 is a flowchart for specifically describing steps of the image processing.

FIG. 6 is a flowchart for specifically describing steps of the image processing performed by the image data processing unit 36 under the control of the CPU 33. For example, when RGB multi-value data represented by 8 bits (256 gradations) are inputted to the image data input unit 31, the image data processing unit 36 first performs color conversion processing in Step S101. The color conversion processing converts the inputted RGB multi-value data to multi-value data corresponding to ink colors CMYK used in the print apparatus. This sort of conversion processing can be performed by, for example, preparing in the storage medium 34 a three-dimensional lookup table in which an output signal CMYK is related to an input signal RGB, and then referring to the table.

In subsequent Step S102, the image data processing unit 36 applies binarization processing to the CMYK multi-value data that have been subjected to the color conversion processing. As a method for the binarization processing, error diffusion processing may be employed; however, a method that performs quantization to N-value lower than 256-value by multi-value error diffusion processing, and then uses a predetermined dot pattern to perform binarization, or other methods may be employed.

In Step S103, the data in which dot printing (1) is set by the binarization processing are respectively distributed into the ejection port arrays. An individual printing datum is controlled on the raster basis that has one pixel width and extends in the y-direction, and a position in the x-direction is determined by the position of the raster; however, which ejection port array, A or C, or B or D, is used to perform printing is determined by distributing according to a predetermined distribution ratio. The distribution ratio may be set to 50% equally for each of the two ejection port arrays, or it may have some deviation. Also, as described in Japanese Patent Laid-Open No. 2008-168628, the distribution ratio may be changed according to the gradation of the image to be printed. In either case, in the array distribution processing step S103, it is determined which ejection port array is used to print all the data in which the printing (1) is set.

In Step S104, among the binary data that have been distributed into the ejection port arrays A to D in the array distribution processing step S103, some data included in the overlapping portion are further distributed into two chips. Even in this step, the distribution ratio between the two chips may be equally set, or may have some deviation. If the distribution ratio is equally set in both the distribution of Step S103 and the distribution of Step S104, a printing ratio in the non-overlapping portion is set to 50% for each of the ejection port arrays, and the printing ratio in the overlapping portion is set to 25% for each of the ejection port arrays.

Figure 7:
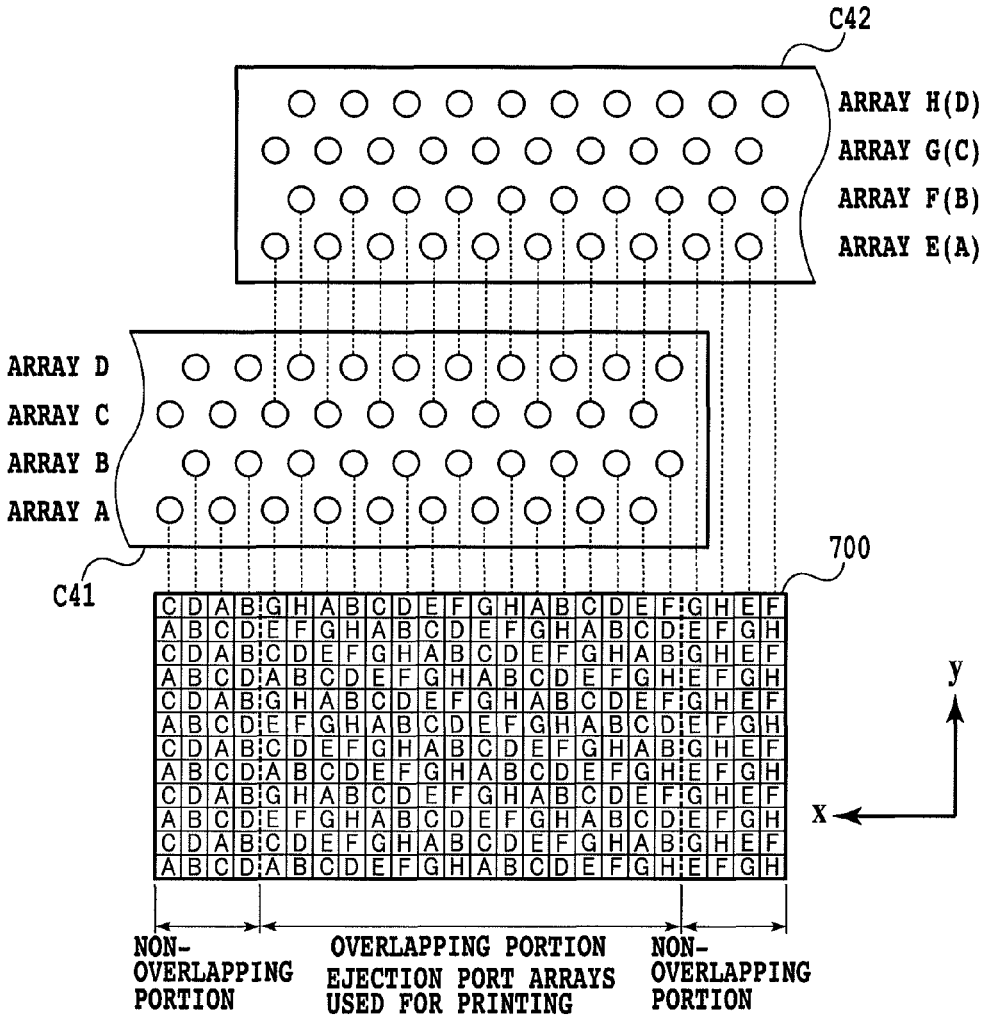
FIG. 7 is a diagram for describing the result of sorting image data into ejection port arrays.

FIG. 7 is a diagram for describing the result of distributing the respective pixel data for a case where the distribution ratio is equally set both in Steps S103 and S109. The diagram illustrates which of the ejection port arrays of the overlapping portion and non-overlapping portions in the chips C41 and C42 each of binary data 700 arrayed at a resolution of 2400 dpi is distributed into. In the diagram, the ejection port arrays of the chip C41 are, as in FIG. 3, indicated by A to D, whereas, the ejection port arrays of the chip C42 are indicated by E to H for convenience.

Figure 8:
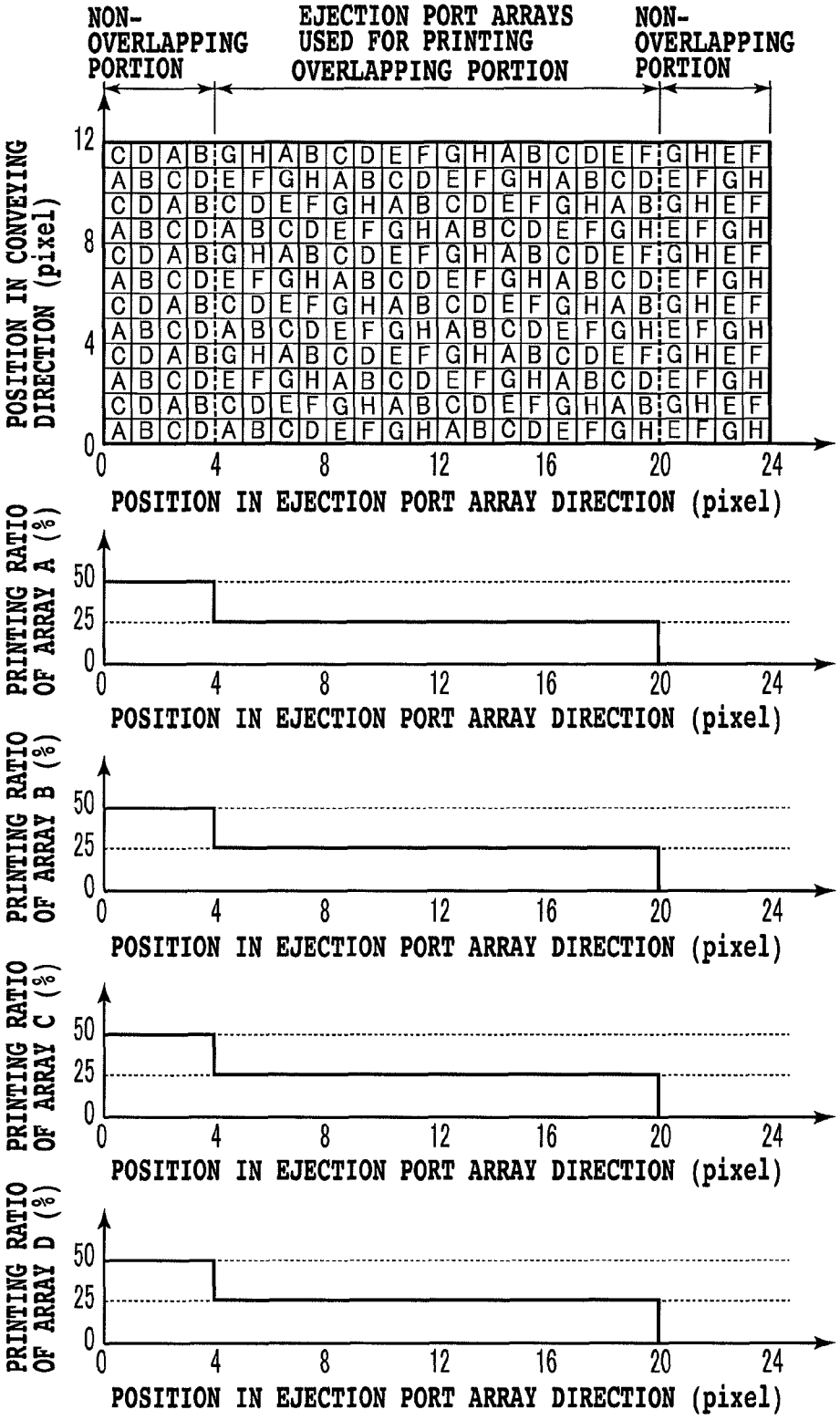
FIG. 8 is a diagram illustrating respective printing ratios of the ejection port arrays A to D.
Figure 9:
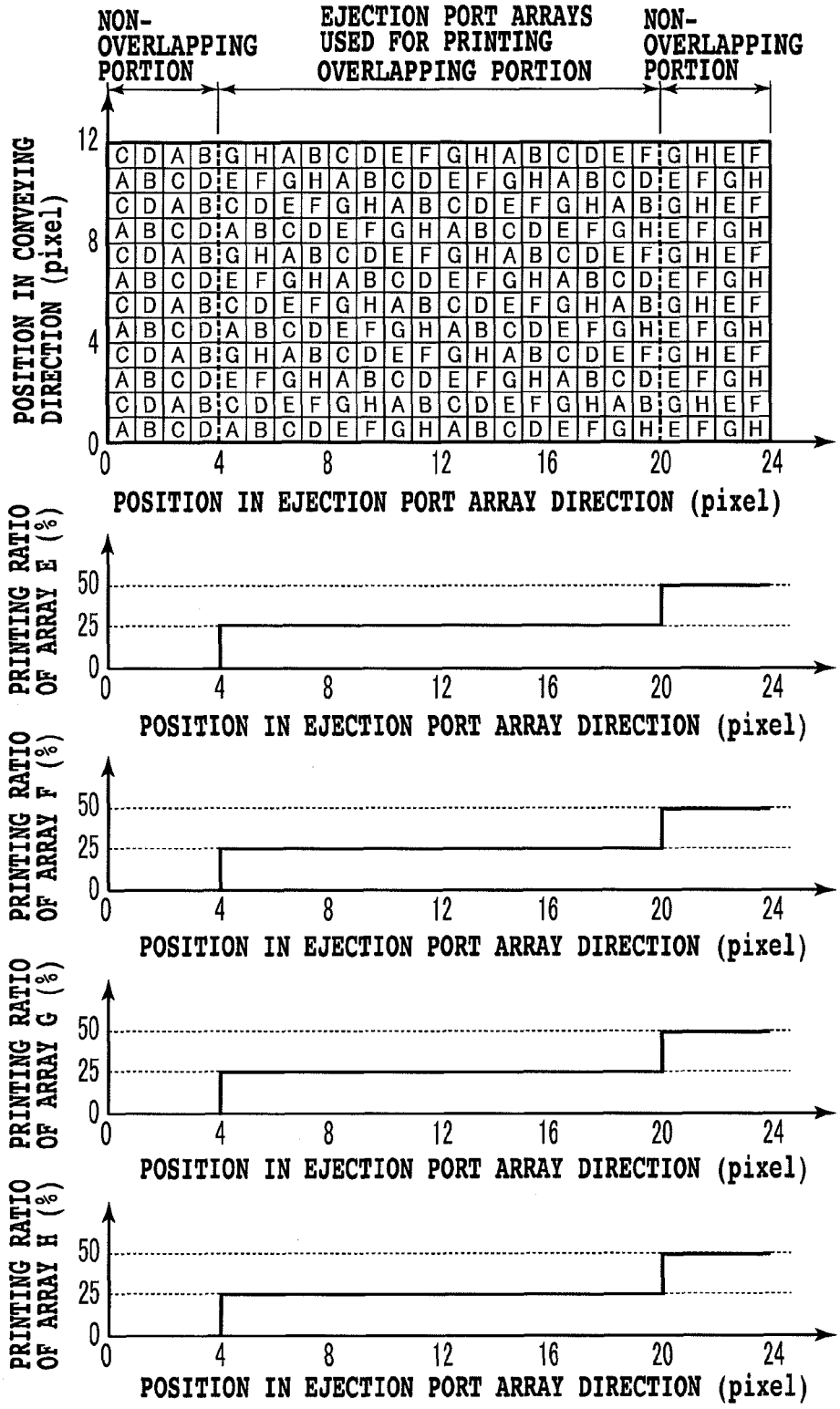
FIG. 9 is a diagram illustrating respective printing ratios of the ejection port arrays E to H.

FIG. 8 is a diagram illustrating respective printing ratios of the ejection port arrays A to D of the chip C41 on the basis of the result of distributing as in FIG. 7. Also, FIG. 9 is a diagram illustrating the respective printing ratios of the ejection port arrays E to H of the chip C42. As can be seen from these diagrams, image data corresponding to the non-overlapping portion of the chip C41 are distributed into the ejection port arrays A to D on the 50% basis, and image data corresponding to the non-overlapping portion of the chip C42 are also distributed to the ejection port arrays E to H on the 50% basis. On the other hand, image data corresponding to the overlapping portion are distributed into the ejection port arrays A to H on the 25% basis.

The diagrams illustrate an example in which in the case where binary data on all pixels are 1 (printing), i.e., a duty of an image is 100%, which of the ejection port arrays prints each of the data. However, in practice, the binary data on all the pixels is not 1 (printing), but pixels representing 1 (printing) and pixels representing 0 (non-printing) are mixed. In the present embodiment, pixels on which binary data are set to 1 (printing) are distributed to all the ejection port arrays equally (or at a processing distribution ratio).

Returning again to the flowchart of FIG. 6, in Step S105, the image data processing unit 34 reads a dot pattern for preliminary ejection on printing medium, which is stored in the storage medium 34 in advance.

Figure 10:
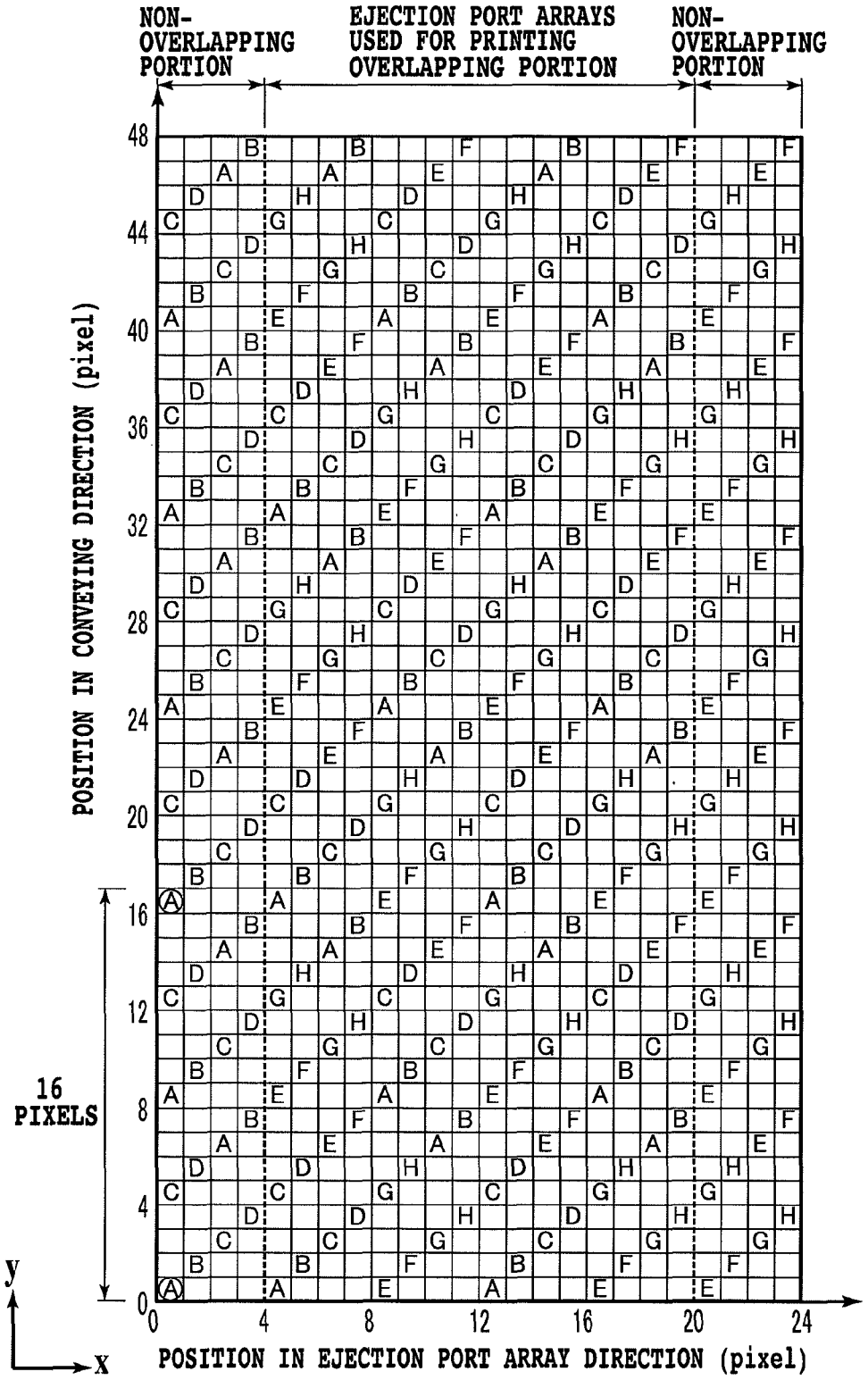
FIG. 10 is a diagram illustrating an example of a dot pattern for preliminary ejection on printing medium.
Figure 12:
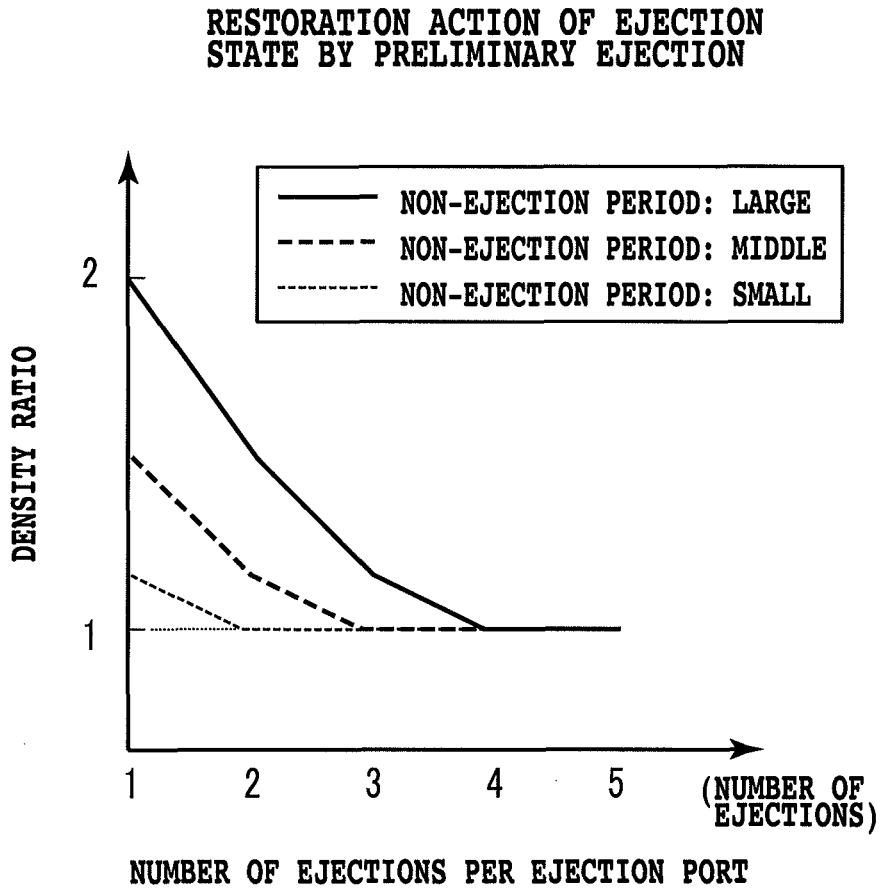
FIG. 12 is a diagram illustrating restoration action of an ejection state by the preliminary ejection.

FIG. 10 is a diagram illustrating an example of the dot pattern for preliminary ejection on printing medium. Pixels to be printed with dots for the preliminary ejection on printing medium and ejection port arrays for printing the pixels are illustrated in an image area that extends in the x-direction (ejection port array direction) and the y-direction (printing medium conveying direction) and has a resolution of 2400 dpi. In an area corresponding to the non-overlapping portion of the chips C41 and C42, dots are arranged such that all ejection ports included in the four ejection port arrays A to D or E to H can equally perform ejection with an equal period (16-pixel period in this case). Also, in an area corresponding to the overlapping portion of the chips C41 and C42, dots are arranged such that all ejection ports included in the eight ejection port arrays A to H can equally perform ejection with an equal period. By configuring the dot pattern for preliminary ejection on printing medium as a diagonal pattern having a certain degree of angle, as compared with a simple ruled-line pattern, the number of dots ejected at the same time can be reduced to prevent the pattern itself from standing out. Also, for simplicity of the diagram here, the pattern configured such that the respective ejection ports print dots with the 16-pixel period is illustrated; however, in practice, it is only necessary to perform ejection with a long period corresponding to approximately a few hundred pixels. If the period is one that is not required to take into account improper ejection, i.e., enables a normal ejection state to be restored, performing the ejecting operation with a period as long as possible enables the pattern for preliminary ejection on printing medium to be prevented from standing out, and ink consumption to be reduced.

Returning again to FIG. 6, in Step S106, the image data processing unit 36 calculates a logical sum of the binary image data obtained in Step S104 and the dot pattern for preliminary ejection on printing medium read in Step S105 to generate actual ejection data for the respective printing elements. Then, the ejection data generated in this manner are transmitted to the image printing unit 37 (Step S107). This completes the present processing. The image printing unit 37 receiving the ejection data prints an image on a printing medium under the control of the CPU 13. The obtained image is one in which the inputted image data and the dot pattern for preliminary ejection on printing medium are printed in the same area.

Next, a test pattern to be printed by the print apparatus of the present embodiment is described. The test pattern in the present specification refers to a pattern in which the printing heads are actually made to print to check printing states of the printing heads. Main test patterns to be printed in the present embodiment include, for example, the following patterns: Firstly, there is a test pattern used for color shading processing for checking color balance of multi dimensional color made by superposition of different ink colors. The color shading processing works to reduce color unevenness of a multi dimensional color printed on a printing medium. Such density unevenness of the multi dimensional color is caused by ejection volume variations among a plurality of printing elements, setting error of chips or printing position error of ink dots. The color shading pattern, used in the color shading processing, is obtained by inputting signals having the same value to the respective printing elements to print a uniform pattern. In this case, if there are one area which is printed by printing elements having a large ejection volume of cyan ink and the other another area which is printed by printing elements having a standard ejection volume of cyan ink, density of cyan image of the one area will be higher than that of the other area. Such density difference of single color (cyan color) can be reduced by the head shading processing described later which works to uniform make ink amount applied to printing medium uniform. However, color unevenness which is occurred occurs in multi dimensional color cannot be resolved by the head shading processing. On the other hand, in color shading processing, a color shading pattern is printed and read to preliminarily check the balance among the respective ink colors. Then, by correcting input data so as to suppress the color unevenness due to the ejection variation, a hue true to the input image can be expressed. The correction of color shading processing may be performed with respect to each of printing elements or with respect to each of printing element groups made of a plurality of printing elements.

Secondly, there is a test pattern used for head shading processing for checking any variation in ejection volumes among printing elements ejecting the same color ink (i.e., density unevenness). The head shading pattern is obtained by inputting signals having the same value to the plurality of printing elements arrayed at predetermined pitches to print a uniform pattern; however, if there is a variation in ejection volume among the printing elements, density unevenness appears in a uniform image printed by a corresponding head. For this case, in the head shading processing, the density unevenness among the printing elements can be checked in advance by reading the head shading pattern. By doing so, decreasing printing data of printing elements corresponding to high density portions, or increasing printing data of printing elements corresponding to low density portions, the density unevenness within the printing head can be reduced.

Also, there is a test pattern used for PWM correction processing or a test pattern used for Pth correction processing. These processings work for adjusting the pulse shape of a voltage pulse to be applied to an individual chip in order to keep ejection volumes balanced among the plurality of chips arrayed on a printing head, or control the ejection volume of an individual chip. These patterns are for checking the ejection volume of an individual chip or a variation in the ejection volume among the chips. If a chip that has an ejection volume that is likely to relatively increase has been checked, by adjusting the width of the voltage pulse to be applied to the chip, a variation in the ejection volume among the chips can be reduced.

Further, there is a test pattern used for non-ejection complement processing for checking the presence or absence of, or a position of a printing element that cannot perform ejection among a plurality of printing elements arranged on a printing head. According to the non-ejection complement pattern, the printing element among the plurality of printing elements arrayed on the printing head that cannot perform ejection can be checked. Also, if the non-ejection is checked, data to be printed by a corresponding printing element are sorted into the other printing elements to perform printing, and thereby loss of the input image data can be avoided.

Still further, there is a test pattern used for registration adjusting processing for checking printing position displacement of a plurality of printing elements arrayed on a printing head. The registration adjusting pattern is a pattern wherein the displacement amount of a dot printed by an individual printing element on a printing medium can be measured. By, depending on the displacement amount of an individual printing element, adjusting timing when the individual printing element performs ejection, or shifting ejection data to an adjacent printing element, an image having no white or black stripe can be printed.

Any of the test patterns as described above is printed upon arrival of the print apparatus or as necessary, and information obtained from the pattern is appropriately used to correct image data for subsequently outputting an image.

For example, if within the head shading pattern, dots by the preliminary ejection are present, a density characteristic of an individual printing element cannot be properly obtained, and therefore appropriate head shading processing (density unevenness correction) may not be performed. Also, if within the non-ejection complement pattern, a dot by the preliminary ejection is present at a position where a non-ejection printing element should perform printing, the presence of the non-ejection printing element cannot be detected. As described, in the case of the pattern that is read with limiting positions of printing elements (or the position of a chip), if an irrelevant dot is printed within the pattern, inconvenience often arises in a subsequent correction.

On the other hand, even if within the color shading pattern, dots by the preliminary ejection are present, if the pattern is read with the dots being included, a normal correction of the color shading processing can be performed. It is because the preliminary ejection on printing medium is also performed in printing of actual image in the present embodiment. As described above, the color shading processing corrects the color unevenness by printing a pattern of multi dimensional color made of a plurality of ink colors and reading the pattern. Therefore, by performing the preliminary ejection on printing medium during printing the test pattern, the test pattern is printed under the same condition as that for the actual image. That is, test pattern can be printed in a condition similar to that of actual image printing compared to a case without the preliminary ejection on printing medium. In other words, by performing the preliminary ejection on printing medium to conform the printing condition to that of an actual printing, an accuracy of correction for the color shading processing is improved.

As described, depending on the purpose of the test pattern printed, dot printing by the preliminary ejection on printing medium may or may not cause an adverse effect. Therefore, in the present embodiment, test pattern printing mode is classified into two modes in which the preliminary ejection on printing medium is performed or not performed.

FIG. 11 is a diagram for describing a relationship between images (actual image and various test patterns) to be printed and performance (ON) or non-performance (OFF) of the preliminary ejection on printing medium. When the actual image is printed, the preliminary ejection on printing medium is turned ON. Such a printing mode is referred to as a third printing mode in the present embodiment. When the color shading pattern (first test pattern), that is one of the test patterns is printed, the preliminary ejection on printing medium is turned ON. Such a printing mode is referred to as a first printing mode in the present embodiment. Further, when the head shading pattern, PWM correction pattern, Pth correction pattern, non-ejection complement pattern, or registration adjusting pattern (second test pattern) is printed, the preliminary ejection on printing medium is turned OFF. Such a printing mode is referred to as a second printing mode in the present embodiment.

As described, in the present embodiment, in addition to the third printing mode for printing the actual image, the first printing mode in which the test pattern is printed using the preliminary ejection on printing medium, and the second printing mode in which any of the test patterns is printed without performing the preliminary ejection on printing medium are prepared. That is, depending on the type or purpose of the test pattern, the performance/non-performance of the preliminary ejection on printing medium is switched. Based on this, in a pattern that is preferably printed under the same condition as that for the actual image, like the color shading pattern, the preliminary ejection on printing medium can be performed to make a correction without taking into consideration improper ejection. On the other hand, in a pattern in which if an irrelevant dot is printed within the pattern, inconvenience is taken into consideration in a subsequent correction, such as the head shading pattern or non-ejection complement pattern, the test pattern is printed without performing the preliminary ejection on printing medium. This enables the test pattern to be printed with high reliability and to be read with high accuracy.

Note that in the embodiment described above, the content in which the plurality of nozzle arrays that are arrayed at the pitches of 1200 dpi and displaced from each other by a half-pitch are prepared to thereby print an image having a resolution of 2400 dpi is used to provide the description; however, the present invention is not limited to such a configuration. For example, there may be a configuration in which four nozzle arrays A to D that are displaced from one another by a ¼-pitch are used to print an image having a resolution of 4800 dpi. Alternatively, there may be a configuration in which ejection port arrays are arranged not to be displaced from each other, and one raster is printed with four ejection port arrays A to D to output an image having a resolution of 1200 dpi. It should be appreciated that the arrangement pitch or resolution of each individual ejection port array is also not limited to that in the above-described embodiment.

Also, in the above-described embodiment, the full-line type inkjet print apparatus that is thought to have a higher need for the preliminary ejection on printing medium is taken as an example to provide the description; however, the present invention can also be applied to a serial type print apparatus. In the case of the serial type inkjet print apparatus, by performing multi-pass printing, a variation in the ejection volume or density unevenness within a printing head can be reduced to some extent; however, a test pattern specific to the serial type print apparatus is also required. Even in the case of printing any test pattern, if the presence of dots by the preliminary ejection on printing medium reduces the accuracy of reading the test pattern, or of calculating a correction value, it is only necessary not to perform the preliminary ejection on printing medium. On the other hand, if the presence of dots by the preliminary ejection on printing medium does not influence the accuracy of reading the test pattern, or of calculating a correction value, it is only necessary to perform the preliminary ejection on printing medium to give priority to ejection stability of an individual printing element similar to the case of a actual image.

Further, in FIG. 4, there is illustrated the inkjet printing head having a mechanism that foams ink by applying a voltage pulse to the heater, and ejects ink corresponding to one dot by growth energy of the form; however, the printing head of the present invention is not limited to such a configuration. For example, even a printing head of a pressure control type that uses a piezo vibration element to eject an ink droplet can be applied to the present invention.

Further, in the above embodiment, the inkjet print apparatus that uses the four color inks of cyan, magenta, yellow, and black to print an image is taken as an example; however, the present invention is not limited to such a configuration. Even the case of using a smaller number of ink colors, or even the case of using a larger number of inks can be applied to the present invention. For example, an inkjet print apparatus that, in addition to the above four colors, uses light inks having a color material density, which is lower than each of the above four color inks and having a similar color to the above four color inks, such as light cyan ink and light magenta ink, to form an image is also acceptable. A dot pattern by the preliminary ejection on printing medium using light ink, such as light cyan ink, light magenta ink, and gray ink or yellow ink tends to hardly stand out as compared to the case of the other ink colors (dark inks) Therefore, in the case of such an ink color, the number of the preliminary ejections on printing mediums can be set larger than those for the other ink colors. Furthermore, for the dark ink whose dots tend to be remarkable, the preliminary ejection on printing mediums may not be performed and only for the light ink, the preliminary ejection on printing mediums may be performed. Similarly, in a case of a print apparatus which can print a plurality of sizes of dots, a number of the preliminary ejections on printing mediums by printing elements which print small dots may be set larger than that of printing elements which print large dots.

The present invention may be applied to a system including a plurality of devices (such as a host computer, interface device, reader, print apparatus, and the like), or to a unit including one device (such as a copier or facsimile device). Also, the image data processing described in FIG. 6 is not limited to the case of performance inside the print apparatus, but may be performed in an external device (computer) for controlling the print apparatus. In such a case, in the external device, up to the step of determination processing of binary data for each ejection port array (up to Step S106 in FIG. 6) is performed, and the binary data are transferred to the print apparatus, where printing is performed on the basis of the transferred data. Accordingly, in the case of performing the above-described characteristic image data processing in the print apparatus, the print apparatus constitutes an image processor of the present invention, whereas in the case of performing the above-described characteristic image data processing in the external device, the external device constitutes the image processor of the present invention.

Also, an embodiment in which an external device (e.g., computer) connected to the print apparatus is supplied with a software program code that realizes the functions of the above-described embodiment, and controls the print apparatus according to the program is also included in the scope of the present invention.

In such a case, the software program code itself realizes the functions of the above-described embodiment, and the program code itself and a unit (e.g., a storage medium storing the program code) configured to supply the program code to the external device (computer) constitute the present invention.

For the storage medium storing such a program code, for example, a floppy (registered trademark) disk, hard disk, optical disk, magnetooptical disk, CD-ROM, magnetic tape, nonvolatile memory card, ROM, or the like can be used.

Also, the present invention is not limited to the case where the computer performs the supplied program code to thereby realize the functions of the above-described embodiment. That is, it should be appreciated that, even in the case where the program code collaborates with an OS, other application software, or the like running on the computer to realize the functions of the above-described embodiment, the program code is included in an embodiment of the present invention.

Further, the supplied program code may be stored in a memory provided on a function extension board of the computer, or in a function extension unit connected to the computer, and then a CPU or the like provided on the function extension board or in the function extension unit may perform a part or the whole of the actual processing. That is, it should be appreciated that the present invention also includes the case where the functions of the above-described embodiment are realized by processing by the CPU or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-187224, filed Aug. 24, 2010, which is hereby incorporated by reference herein in its entirety.

What is claimed is:

1. An inkjet print apparatus for printing an actual image based on inputted image data and a first test pattern and a second test pattern which are different from the actual image, comprising:

a print head having a plurality of nozzles configured to eject a first color ink and a second color ink, the second color being different from the first color; and a controller which executes steps of:

causing the print head to print the first test pattern, which is a specified pattern configured to correct color of the actual image by ejecting both of the first color ink and the second color ink, while also printing a preliminary ejection pattern for maintaining ejection conditions of the plurality of nozzles on an area where the first test pattern is printed;

causing the print head to print the second test pattern, which is a specified pattern configured to check the printing state of the plurality of nozzles and is different from the first test pattern, by ejecting the first color ink and not ejecting the second color ink, without printing of a preliminary ejection pattern for maintaining ejection conditions of the plurality of nozzles on an area where the second test pattern is printed;

correcting the color of the actual image on the basis of the first test pattern; and causing the print head to print the actual image by ejecting both of the first color ink and the second color ink, while also printing a preliminary ejection pattern for maintaining ejection conditions of the plurality of nozzles on an area where the actual image is printed, wherein the first test pattern includes a pattern for reducing a color difference between a color that is printed in a first region by using the first color ink and the second color ink according to data indicating a predetermined color and a color that is printed in a second region different from the first region by using the first color ink and the second color ink according to data indicating the predetermined color.

2. The inkjet print apparatus according to claim 1, further comprising:

a processor which executes a step of generating printing data on the basis of data for the first test pattern and data for the preliminary ejection pattern, and wherein the controller executes the step of printing the first test pattern and the preliminary ejection pattern on the basis of the printing data generated by the processor.

3. The inkjet print apparatus according to claim 2, wherein the processor executes the step of generating the printing data by performing logical addition of the data for the first test pattern and data for the preliminary ejection pattern.

4. The inkjet print apparatus according to claim 1, further comprising:

a processor which executes a step of generating printing data on the basis of data for the actual image and data for the preliminary ejection pattern, and wherein the controller executes the step of causing the print head to print the actual image and the preliminary ejection pattern on the basis of the printing data generated by the processor.

5. The inkjet print apparatus according to claim 1, wherein the second test pattern includes a test pattern for checking an ejection volume variation among the plurality of nozzles that eject the first color ink in the print head.

6. The inkjet print apparatus according to claim 5, wherein the second test pattern includes a test pattern for checking displacements of printing positions on the printing medium of the plurality of nozzles that eject the first color ink in the print head.

7. The inkjet print apparatus according to claim 1, wherein the second test pattern includes a test pattern for checking the presence or absence of and the position of a nozzle that cannot perform ejection among the plurality of nozzles that eject the first color ink in the print head.

8. The inkjet print apparatus according to claim 1, wherein the print head is configured to arrange a plurality of chips each having the plurality of nozzles arrayed in a predetermined direction while providing an overlapping portion such that end portions of the plurality of chips are overlapped in a direction intersecting with the predetermined direction and the arrays of the nozzles are made continuous in the predetermined direction.

9. The inkjet print apparatus according to claim 8, wherein the second test pattern includes a test pattern for checking balance in the ejection volume among the plurality of chips that eject the first color ink in the print head.

10. The inkjet print apparatus according to claim 8, wherein the second test pattern includes a test pattern for checking ejection volumes of the plurality of chips that eject the first color ink in the print head.

11. An inkjet print apparatus for printing an actual image based on inputted image data and a first test pattern and a second test pattern which are different from the actual image, comprising:

a print head having a plurality of nozzles configured to eject a first color ink and a second color ink, the second color being different from the first color; and a controller which executes steps of:

causing the print head to print the first test pattern, which is a specified pattern configured to reduce a color difference between a color that is printed in a first region by using the first color ink and the second color ink according to data indicating a predetermined color and a color that is printed in a second region different from the first region by using the first color ink and the second color ink according to data indicating the predetermined color, by ejecting both of the first color ink and the second color ink, while also printing a preliminary ejection pattern for maintaining ejection conditions of the plurality of nozzles on an area where the first test pattern is printed;

causing the print head to print the second test pattern, which is a specified pattern configured to check an ejection volume variation among the plurality of nozzles that eject the first color ink in the print head, by ejecting the first color ink and not ejecting the second color ink, without printing of a preliminary ejection pattern for maintaining ejection conditions of the plurality of nozzles on an area where the second test pattern is printed;

correcting the color of the actual image on the basis of the first test pattern; and causing the print head to print the actual image by ejecting both of the first color ink and the second color ink, while also printing a preliminary ejection pattern for maintaining ejection conditions of the plurality of nozzles on an area where the actual image is printed.

12. An inkjet print apparatus for printing an actual image based on inputted image data and a first test pattern, a second test pattern, a third test pattern, and a fourth test pattern which are different from the actual image, comprising:

a print head having a plurality of nozzles configured to eject a first color ink and a second color ink, the second color being different from the first color; and a controller which executes steps of:

causing the print head to print the first test pattern, which is a specified pattern configured to reduce a color difference between a color that is printed in a first region by using the first color ink and the second color ink according to data indicating a predetermined color and a color that is printed in a second region different from the first region by using the first color ink and the second color ink according to data indicating the predetermined color, by ejecting both of the first color ink and the second color ink, while also printing a preliminary ejection pattern for maintaining ejection conditions of the plurality of nozzles on an area where the first test pattern is printed;

causing the print head to print the second test pattern, which is a specified pattern configured to check an ejection volume variation among the plurality of nozzles that eject the first color ink in the print head, by ejecting the first color ink and not ejecting the second color ink, without printing of a preliminary ejection pattern for maintaining ejection conditions of the plurality of nozzles on an area where the second test pattern is printed;

causing the print head to print the third test pattern, which is a specified pattern configured to check the presence or absence of and the position of a nozzle that cannot perform ejection among the plurality of nozzles that eject the first color ink in the print head, by ejecting the first color ink and not ejecting the second color ink, without printing of a preliminary ejection pattern for maintaining ejection conditions of the plurality of nozzles on an area where the third test pattern is printed;

causing the print head to print the fourth test pattern, which is a specified pattern configured to check displacements of printing positions on the printing medium of the plurality of nozzles that eject the first color ink in the print head, by ejecting the first color ink and not ejecting the second color ink, without printing of a preliminary ejection pattern for maintaining ejection conditions of the plurality of nozzles on an area where the fourth test pattern is printed;

correcting the color of the actual image on the basis of the first test pattern; and causing the print head to print the actual image by ejecting both of the first color ink and the second color ink, while also printing a preliminary ejection pattern for maintaining ejection conditions of the plurality of nozzles on an area where the actual image is printed.

* * * * *